US007270076B2

(12) United States Patent
Evans

(10) Patent No.: US 7,270,076 B2
(45) Date of Patent: Sep. 18, 2007

(54) FLAG POLE MOUNTED UNFURLING DEVICE

(76) Inventor: Arthur Lee Evans, 5579 Baja Dr., San Diego, CA (US) 92115

( * ) Notice: Subject to any disclaimer, the term of this patent is extended or adjusted under 35 U.S.C. 154(b) by 0 days.

(21) Appl. No.: 11/106,365

(22) Filed: Apr. 13, 2005

(65) Prior Publication Data

US 2005/0235902 A1 Oct. 27, 2005

Related U.S. Application Data

(60) Provisional application No. 60/561,644, filed on Apr. 13, 2004.

(51) Int. Cl.
*G09F 17/00* (2006.01)

(52) U.S. Cl. ..... 116/174

(58) Field of Classification Search ..... 116/173, 116/174

See application file for complete search history.

(56) References Cited

U.S. PATENT DOCUMENTS 842,693 A * 1/1907 Patterson ..... 40/479
1,306,915 A * 6/1919 Klamroth ..... 116/174
1,742,574 A * 1/1930 Breedlove ..... 73/170.06
2,168,484 A * 8/1939 Raymond ..... 116/173
3,042,940 A * 7/1962 Keaton ..... 5/654
3,675,615 A * 7/1972 Stangarone et al. ..... 116/173
3,706,297 A * 12/1972 Voorhees ..... 116/174
3,996,882 A * 12/1976 Martin et al. ..... 116/174
4,052,957 A * 10/1977 Lee ..... 116/174
5,044,301 A * 9/1991 Peters et al. ..... 116/174
5,988,100 A * 11/1999 Schmitt ..... 116/173
2002/0178997 A1* 12/2002 Tsui-Hua ..... 116/174
2005/0263061 A1* 12/2005 Llewellyn ..... 116/174

* cited by examiner

*Primary Examiner*—Richard Smith
*Assistant Examiner*—Travis Reis
(74) *Attorney, Agent, or Firm*—Gary L. Eastman, APLC

(57) ABSTRACT

A flag pole mounted unfurling device is installed on a flagpole and rotates to minimize the unwanted furling of the flag. The device includes a lower swivel, an upper swivel, and a baton that extends between the lower swivel and the upper swivel to retain the two swivels in alignment and properly separated. The upper swivel and lower swivel are free to rotate around the axis of the pole while the baton serves to couple the upper and lower swivels together, both rotationally and longitudinally. The entire assembly is longitudinally retained on the pole by an upper collar and a lower collar and minimizes the unwanted furling of a flag through 'dynamic instability.'

20 Claims, 19 Drawing Sheets

FLAG POLE MOUNTED UNFURLING DEVICE

RELATED APPLICATIONS

This application claims the benefit of priority to U.S. Provisional Patent Application Ser. No. 60/561,644 entitled "Flag Pole Mounted Unfurling Device" and filed on Apr. 13, 2004, currently co-pending.

FIELD OF THE INVENTION

The present invention is useful as a device for hanging flags from a flagpole. The present invention is more particularly, though not exclusively, useful as a rotational mount from which a flag can be suspended to prevent the unwanted furling of the flag about the pole.

BACKGROUND OF THE INVENTION

Throughout the years, flag poles have been used for symbolism, patriotism, and generally for displays of various kinds. For instance, a public or private building may have an American flag displayed on a pole on the grounds of the building, or hanging from a pole that extends from the building. Also, private citizens may use flags for patriotic purposes, such as an American flag, or for other purposes, such as a flag signaling the start of Spring, an upcoming holiday, or event.

Regardless of the type of flag being displayed, or the method of displaying the flag, a common dilemma occurs. Specifically, when a flag is displayed s outdoors, the wind causes the flag to whip about. This whipping action results in the flag becoming wrapped around the pole. This is called furling, and results in a shabby appearance of the flag, and prevents the proper viewing of the flag. In some circumstances, the flag may naturally unfurl, however, more commonly the flag will have to be manually unfurled back to its ordinary hanging position.

In light of the above, it would be advantageous to provide a device which would minimize the furling of a flag in the first place. This device would be mounted to the flag pole and prevent the whipping of the flag to result in a furled flag.

SUMMARY OF THE INVENTION

The flag unfurling device of the present invention is installed on a flagpole, and includes a lower swivel, an upper swivel and a baton that extends between the lower swivel and the upper swivel to retain the two swivels in alignment and properly separated and allows the upper swivel and lower swivel to rotate around the axis of the pole. The baton serves to couple the upper and lower swivels together, both rotationally and longitudinally, and the entire assembly is longitudinally retained on the pole by an upper collar and a lower collar. A flag mounts to the swivels and diametrically opposite to the baton and held in place. The baton, responsive to the wind gusting, provides some positional stability on the flag mounting, and minimizes any furling of the flag. Further, because the moment of inertia is increased on the furled flag around the baton due to the distance from the axis of rotation, the flag has a lesser tendency to furl, and the increased rotational moment allows the device to unfurl itself more readily.

BRIEF DESCRIPTION OF THE DRAWINGS

The novel features of this invention, as well as the invention itself, both as to its structure and its operation, will be best understood from the accompanying drawings, taken in conjunction with the accompanying description, in which reference characters refer to similar parts, and in which.

DETAILED DESCRIPTION OF THE INVENTION

This device of the present invention is useful to prevent a flag mounted on a flagpole from wrapping around the pole and becoming tangled (commonly referred to as "furling"). The present invention is particularly useful when used in conjunction with flagpoles that are mounted at an angle to the vertical. This unwanted furling of the flag results from abrupt changes in wind velocity (gusting) that causes the flag to wrap around the pole, typically over the pole from a down-wind direction.

Figure 1:
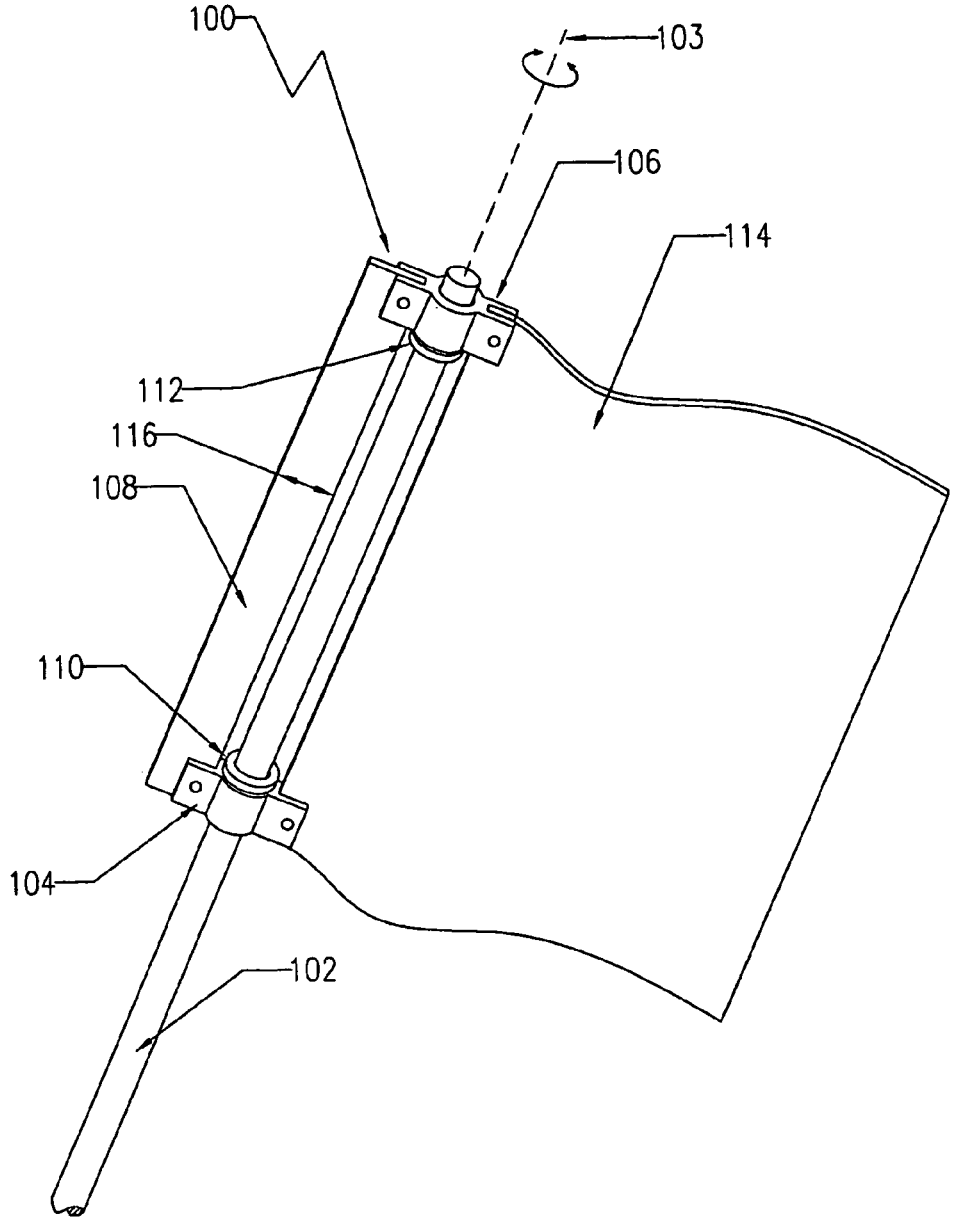
FIG. 1 is a perspective view of the flag unfurling device of the present invention showing an upper swivel, a lower swivel, and a pair of flag mounting tabs for receiving the eyelets of a flag, with a stabilizing baton opposite the flag.

Referring to FIG. 1, the flag unfurling device of the present invention is shown and generally designated 100. Device 100 is shown in FIG. 1 as being installed on a flagpole 102 and may be rotated as shown along flagpole axis 103. Device 100 includes a lower swivel 104, an upper swivel 106 and a baton 108 that extends between the lower swivel 104 and the upper swivel 106 to retain the two swivels in alignment and properly separated.

Upper swivel 106 and lower swivel 104 are free to rotate around the axis 103 of the pole 102. The baton 108, or sail, serves to couple the upper and lower swivels 104 and 106 together, both rotationally and longitudinally. The entire assembly is longitudinally retained on the pole 102 by an upper collar 112 and a lower collar 110. A flag 114 mounts to the swivels 104 and 106 diametrically opposite to the baton 108 in this embodiment.

The unfurling device of the present invention minimizes the unwanted furling of a flag through 'dynamic instability.' Dynamic instability includes multiple contributing factors with the following four (4) effects the most pronounced:

a) counter-balancing weight of the baton/sail;

b) increased rotational moment due to the baton/sail height;

c) aerodynamics and wind force on the baton/sail; and d) coupling of the swivels by the baton/sail.

Each of these effects is discussed in greater detail below.

Angular Pole Mounting

The following description of the action of the device of the present invention pertains to angular pole mounting (typically 30-60° to horizontal), however, this analysis also works for any angle less than vertical. When the flag 114 is displayed in low wind conditions the weight of the flag 114 overcomes the weight of the baton/sail 108 and the flag 114 hangs down, as shown in FIG. 2A. This position is referred to as the 'rest position' (0°). When wind velocity increases, the aerodynamic force of the flag 114 overcomes that of the baton/sail 108 and the flag 114 moves out to follow the wind direction, as shown in FIG. 2B. This action rotates the baton/sail into the wind thereby minimizing wind force upon the flag 114 and baton/sail 108. When the flag 114 wraps over the is pole 102 as shown in FIG. 2C, the flag 114 also wraps over the baton/sail 108. The baton/sail 108 has a height 116 that acts to increase the rotational moment of the flag 114 about the pole 102 due to the distance 118 to the center of the pole 102. (Moment=force×distance)

Often, the weight of the falling flag 114 acting on the baton/sail 108 will 20 cause the entire assembly 100 to rotate, with the rotational momentum carrying the baton/sail 108 through its lowest point after which the flag weight becomes dominant, returning the assembly 100 to its resting position. If the weight of the flag is insufficient to rotate the assembly into the correct orientation, or the effect of the wind (and/or weights) was minimized due to the angular position of the baton/sail 108, the force of the next wind gust upon the flag will cause rotation of the flag and assembly back to the proper resting position.

Figure 3:
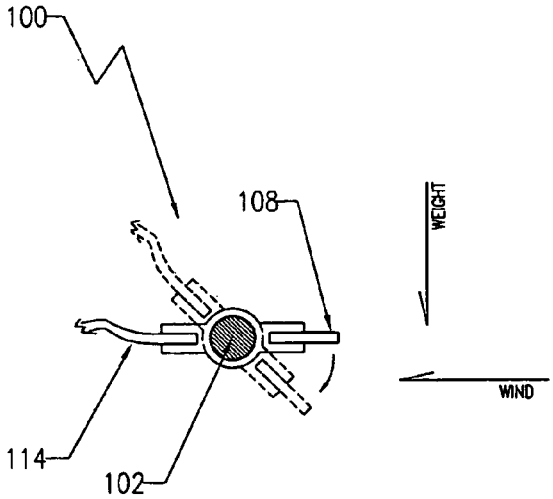
FIG. 3 is a cross-sectional view of the flag unfurling device of the present invention showing the natural unfurling tendency of the present device.

In addition to the discussion above, it is to be appreciated that there are other factors which influence the action of the flag unfurling device of the present invention. For instance, as the flag 114 is wrapping over the pole 102 (reversing direction from its free flying orientation), it has a period of time where it is exerting no (or little) force on the assembly, effectively weightless. This can cause the weight of the baton/sail 108 to rotate the assembly 100 as shown in FIG. 3 such that the baton/sail 108 is presenting a more oblique angle to the airflow. The wind and baton/sail weight act to rotate the assembly 100 in the same direction that the flag is furling, tending to correct the furling even as it is happening.

Figure 2:
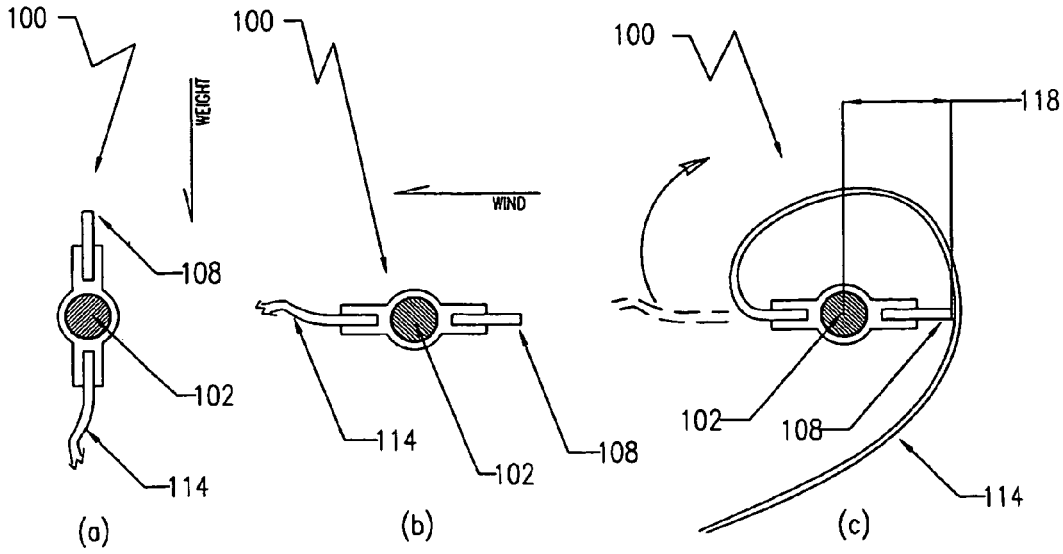
FIG. 2 is a cross-sectional view of the flag unfurling device of the present invention showing the operation of the device in response to wind striking the various surfaces and showing the furling of a flag due to the whipping wind.

It is worth noting that the force systems acting on the present invention are orthogonal. More specifically, when the assembly 100 is at 0° (rest position) (FIG. 2(*a*)) and 180° the wind effect is greatest and the effect of the masses is minimal. When the assembly 100 is at 90° as shown in FIG. 2B, and at 270° the effect of the masses is greatest and the wind effect is minimal. The contribution of these effects to the over-all system is sinusoidal and out of phase. This is the aforementioned 'dynamic instability.'

Figure 4:
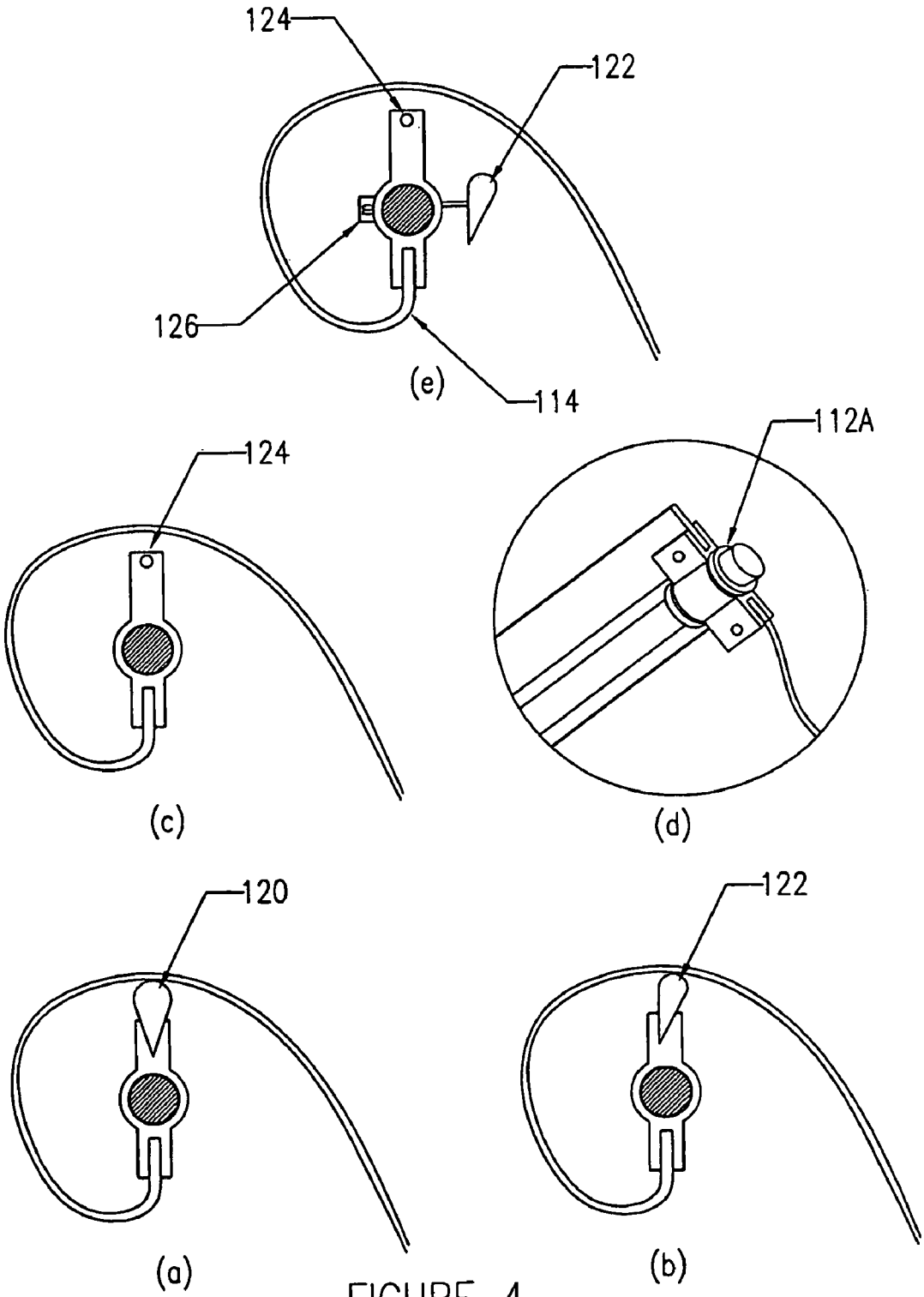
FIG. 4 is a cross-sectional view of alternative embodiment of the flag unfurling device of the present invention.

Other possible embodiments of the device of the present invention include the baton/sail 120 having the shape of a symmetrical airfoil as shown in FIG. 4A, or having a wing-like cross-section as shown as airfoil 122 of FIG. 4B. Another embodiment of the present invention would include the baton/sail replaced with a larger more sail-like shaped object of either rigid material or fabric that would perform as above but, with increased aerodynamic effects and greater surface area, which could also be used for display or advertising. Another embodiment would minimize the cross-section and resulting aerodynamic effects of the baton/sail, such as with a rod or wire 124 shown in FIG. 4C.

It can be appreciated that by varying the proportional effects of weight, moment distance 118 and aerodynamic forces of the device of the present invention, many differing effects and characteristics may be achieved. For instance, adding mass to the baton/sail 108 and increasing the moment distance 118 (which would also increase the aerodynamic effects) would change the dynamic characteristics of the device.

A different embodiment of the collar placement 112A as shown in FIG. 4D may facilitate the manufacturing process and/or aesthetic advantages in that it places both collars around a single swivel and could facilitate capping the pole end for a more aesthetically pleasing pole end. Other mounting angles between the flag and baton/sail are possible and are fully contemplated herein. It is feasible to separate all contributing effects (flag mass 114, counterbalance mass 126, aerodynamic forces 122 and increased moment 124) and place them at different relative angles as shown in FIG. 4E. It is also to be appreciated that the shape of the swivels 104 and 106 as shown are typical, but many alternative shapes are possible without departing from the spirit of the present invention. Additionally, the swivels 104 and 106 may be a unitary piece, or can be a multi-part assembly. It is feasible that the rotation of the device 100 about the axis 103 of the pole 102 could be utilized to manually furl the flag 114, such as for storage purposes.

Vertical Pole Mounting

The following description of the action of the device of the present invention pertains to vertical pole mounting (90° to horizontal). The action of the device when mounted vertically is similar to that described for Angular Pole Mounting, the most remarkable departure being that the effects of the mass of the flag 114 and the mass of the baton/sail 108 are trivial. Without the counter-balancing mass of the baton/sail 108, the following effects are most pronounced:

a) increased rotational moment due to the baton/sail height 116;

b) aerodynamics and wind force on the baton/sail 108 (or 122); and c) coupling of the swivels 104 and 106 by the baton/sail 108 (or 122).

Without the effect of the masses, the aerodynamic effects (wind pressure and lift) are even more pronounced. While the device of the invention as depicted in FIG. 1 performs well when mounted vertically, many other embodiments (in addition to those already set forth) are possible and fully contemplated herein.

Figure 5:
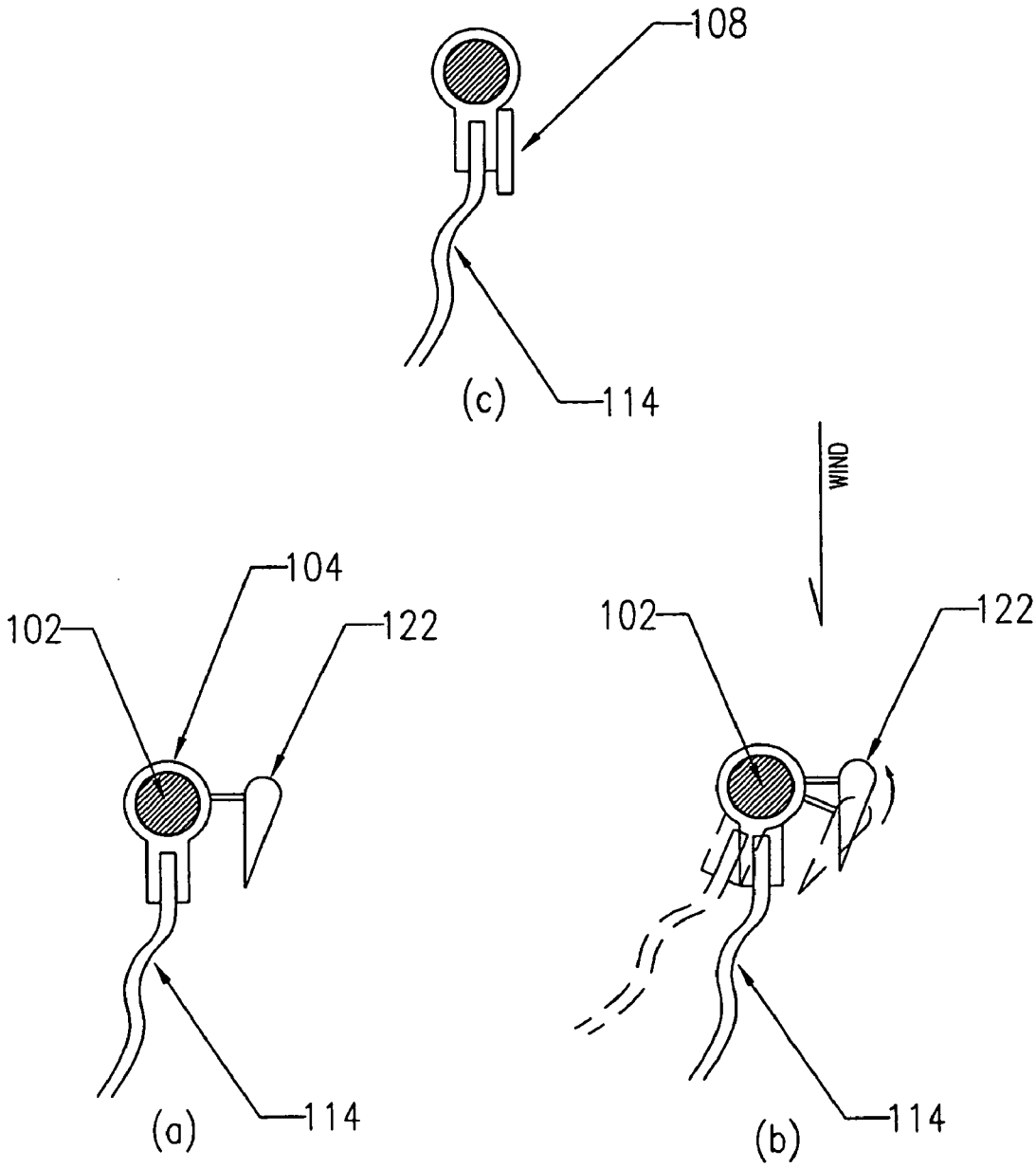
FIG. 5 is a cross-sectional view of an alternative embodiment of the flag unfurling device of the present invention having an airfoil baton assisting with the proper orientation of the flag on the flag pole.

One embodiment for the device as applied to vertical pole mounting is depicted in FIG. 5A. The airfoil 122 is attached to the swivels 104 and 106 at a 90° off-set and parallel to the flag 114. Changes in wind direction cause the assembly 100 to be oriented obliquely to the wind. The aerodynamic forces acting on the flag 114 and airfoil 122 cause the assembly 100 to rotate about the pole 102 as shown in FIG. 5B until equilibrium is re-established. It is worth noting that changing the location of the attachment point to the airfoil 122 influences the magnitude and direction of its rotational effect. Other mounting angles between components and many baton/sail 108 or airfoil 122 shapes and mounting approaches, including multiple airfoils, are possible and are fully contemplated herein.

Figure 17:
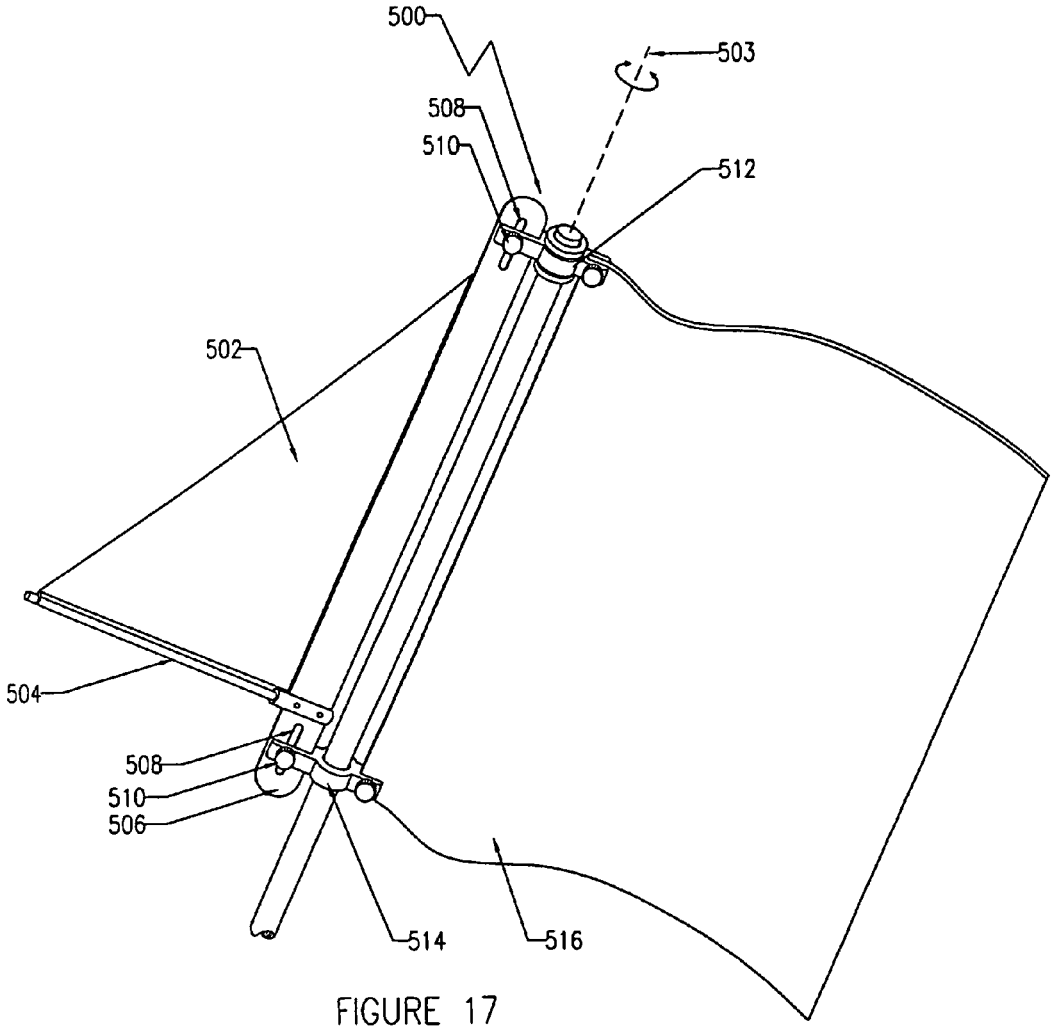
FIG. 17 is an alternative embodiment of the flag unfurling device of the present invention showing a triangular shaped sail extending from a baton formed with a single adjustment slot on each end.

The addition of a triangular jib-type fabric sail (as shown in FIG. 17) has even more application in this embodiment. The lower edge (foot) of the sail is supported with a sprit-like pole cantilever mounted into the lower swivel 104. Another embodiment would have a rigid sail mounted to the swivels 104 and 106.

Other possible embodiments of the device of the present invention include minimizing the aerodynamic effects of the baton/sail 108 by placing it nearby the flag 114 as shown in FIG. 5C. Another embodiment would retain the aerodynamic effects of the airfoil 122, but uncouple the swivels 104 and 106 to allow independent action about the pole 102.

Figure 21:
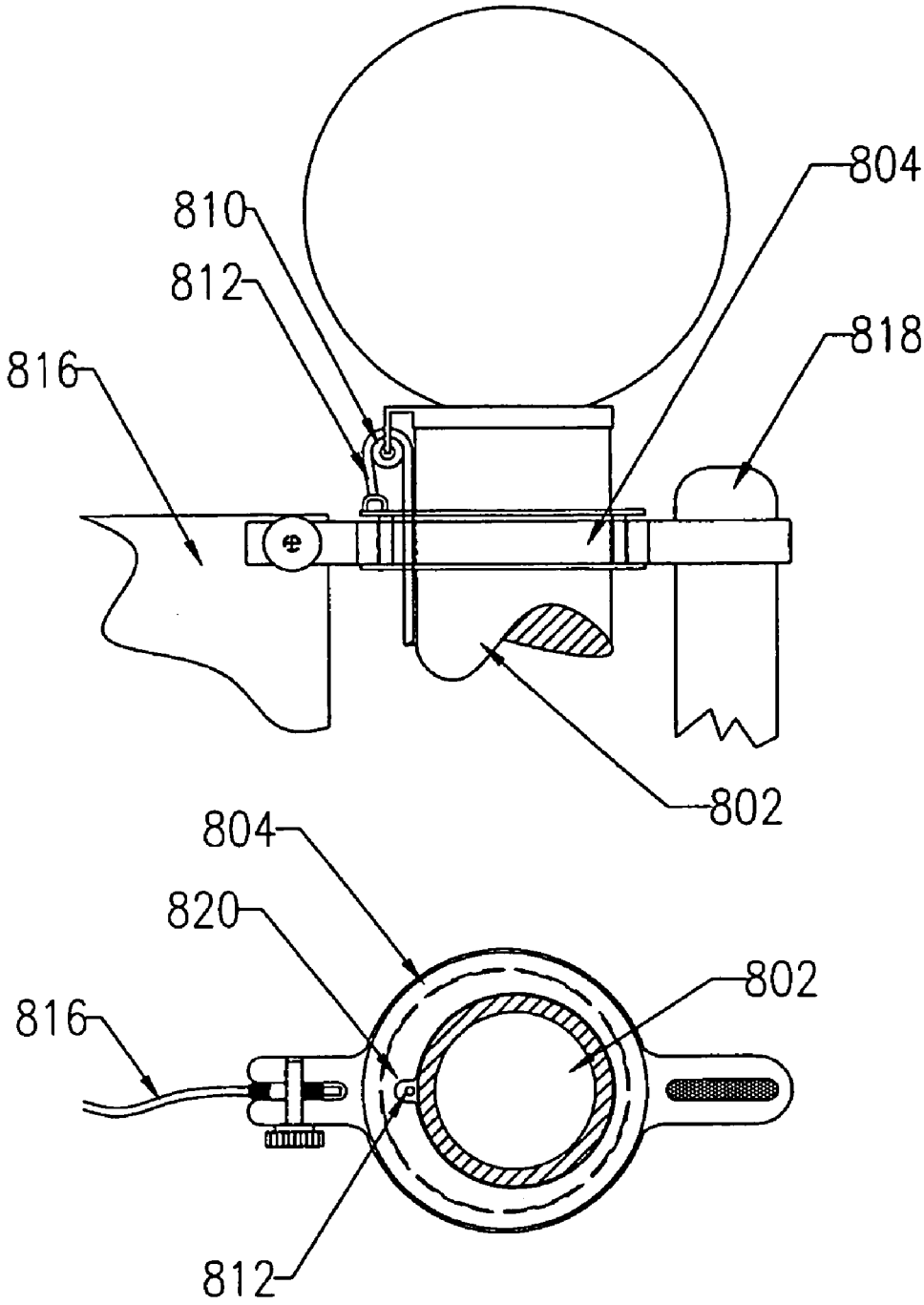
FIG. 21 is a cross-sectional view of the upper swivel attachment detailing the positioning of the swivel on the flag pole, and the routing of the cord.

This invention could easily be configured for or as a "drop-in" installation atop a telescoping flagpole. Installation on a conventional vertical pole could require a sleeve-like component for attachment to the halyard (as shown in FIG. 21), allowing unencumbered rotation. This device may be positioned on the pole by placing it over the top of the pole and sliding downwards. Alternatively, in situations where it is not practical to reach the top of the flagpole, the swivels of the present invention may be designed to open sufficiently to receive the pole, and to then close around the pole and slide thereon.

ALTERNATIVE EMBODIMENTS

Figure 6:
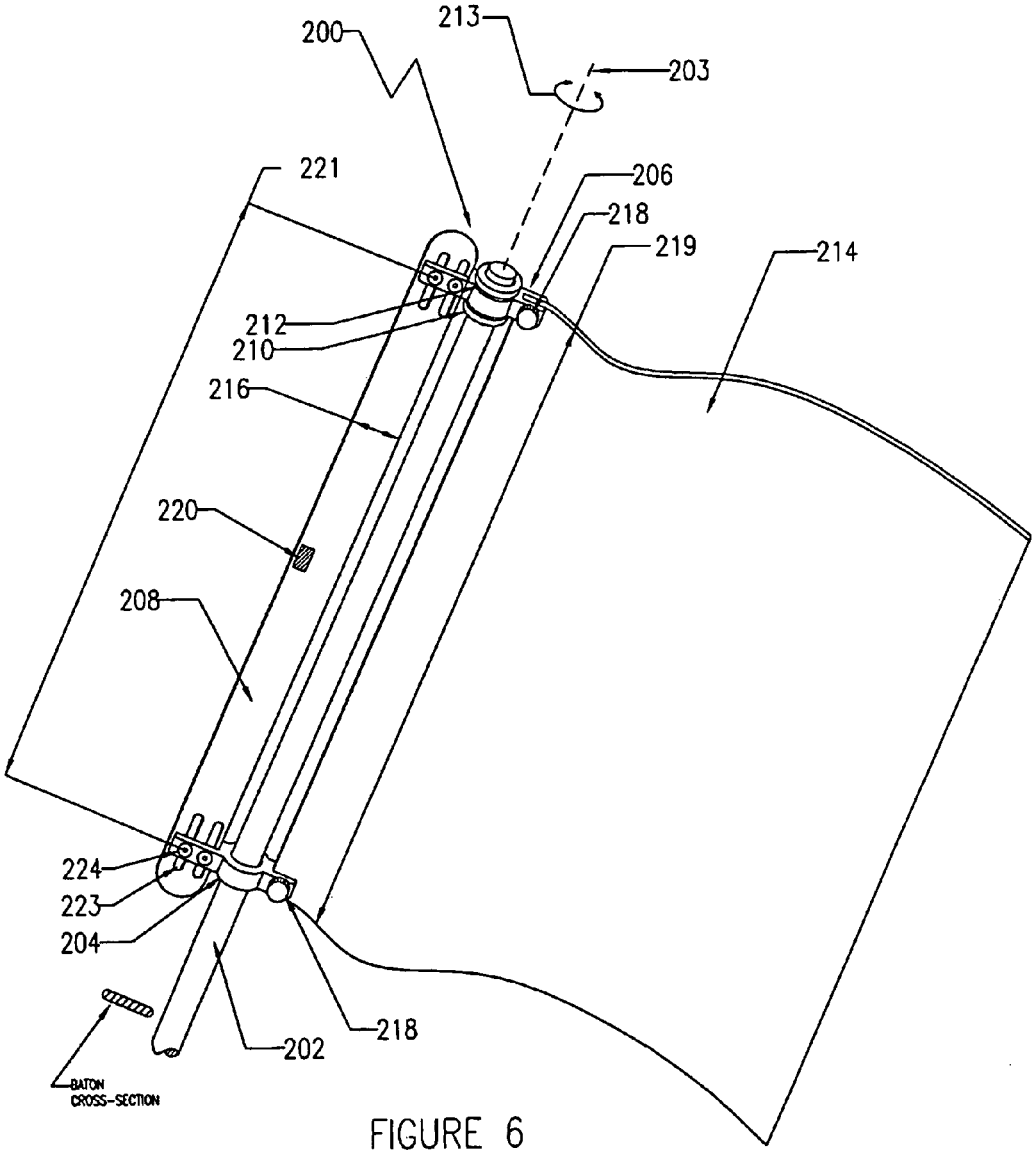
FIG. 6 is a perspective view of an alternative embodiment of the flag unfurling device of the present invention having a baton formed with adjustment slots sized to be adjusted within the upper and lower swivels thereby accommodating flags having different heights.

Referring now to FIG. 6, a perspective view of an alternative embodiment of the flag unfurling device of the present invention is shown and generally designated 200. Device 200 is mounted on a flag pole 202 and includes a lower swivel 204 and an upper swivel 206 which together support a baton 208. The upper swivel 206 is retained on pole 202 by retaining rings 210 and 212, which maintain the upper swivel 206 in proper position, while allowing the free rotation of the swivel around the axis 203 of pole 202. A flag 214 is attached to the upper and lower swivels 204 and 206 with thumb screws 218, and the baton 208 maintains the distance 221 appropriate to hold flag 214 in place.

The baton 208 has a width 216 than can vary by application, with particular widths being dependent on the height 219 of the flag 214, such as a larger width 216 for a bigger flag. Additionally, the weight of baton may be increased by adding weights 220 to increase the weight, and overall moment of inertia, of the baton assembly. Baton 208 is also formed with adjustment slots 223 sized to be adjusted within the upper and lower swivels thereby accommodating flags having different heights. Screws 224 may be tightened to fix the distance 221, thereby maintaining the flag 214 in a proper position for hanging.

Figure 7:
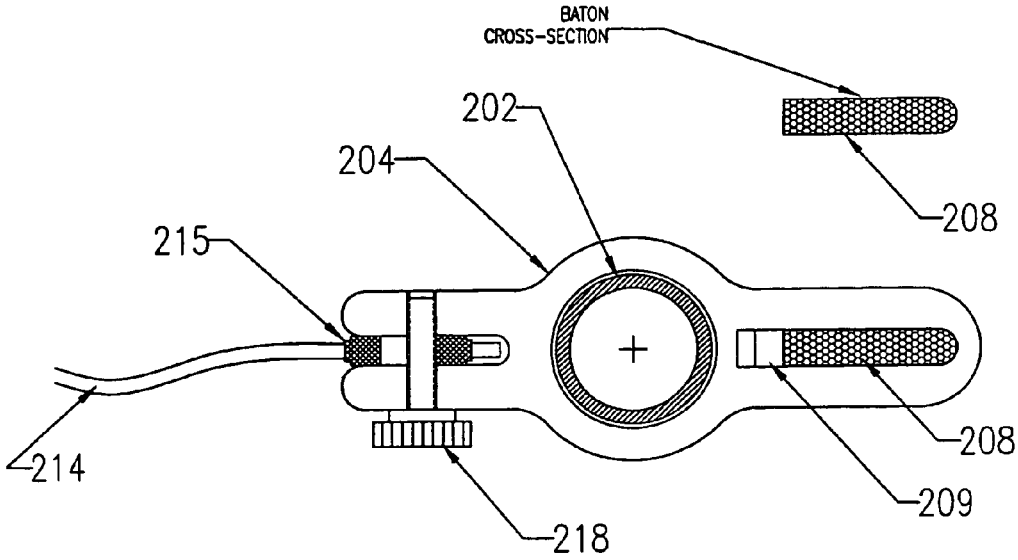
FIG. 7 is a cross-sectional view of a swivel for the flag unfurling device of the present invention showing a thumbscrew that threads easily into the swivel to facilitate the mounting and removal of a flag from the device.

FIG. 7 is a cross-sectional view of swivel 204 for the flag unfurling device of the present invention 200 showing a thumb-screw 218 that threads easily into the swivel 204 and through eyelet 215 of flag 214. This mounting facilitates the installation and removal of flag 214 from the device 200. Also, the baton is enclosed within a channel formed in the swivel 204 which provides a capturing effect for the use of the wedge-locks as described below.

Figure 8:
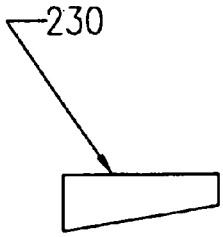
FIGS. 8 and 9 are side views of wedges used to adjust the positioning of the swivels along the baton.
Figure 9:
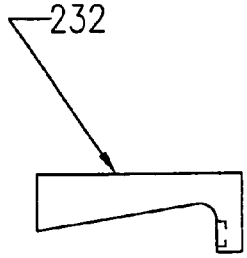

Referring to FIGS. 8 and 9, side views of wedges used to adjust the positioning of the swivels on the flag pole are shown. Specifically, wedge 230 of FIG. 8 is designed to be inserted adjacent the baton 208 and in gap 209 to securely lock baton 208 in swivel 206. Wedge 232 is similar to wedge 230, and equipped with a spring retaining the wedge in place. Additional discussion regarding the wedge-lock mechanism is discussed in conjunction with FIGS. 10 and 11.

Figure 10:
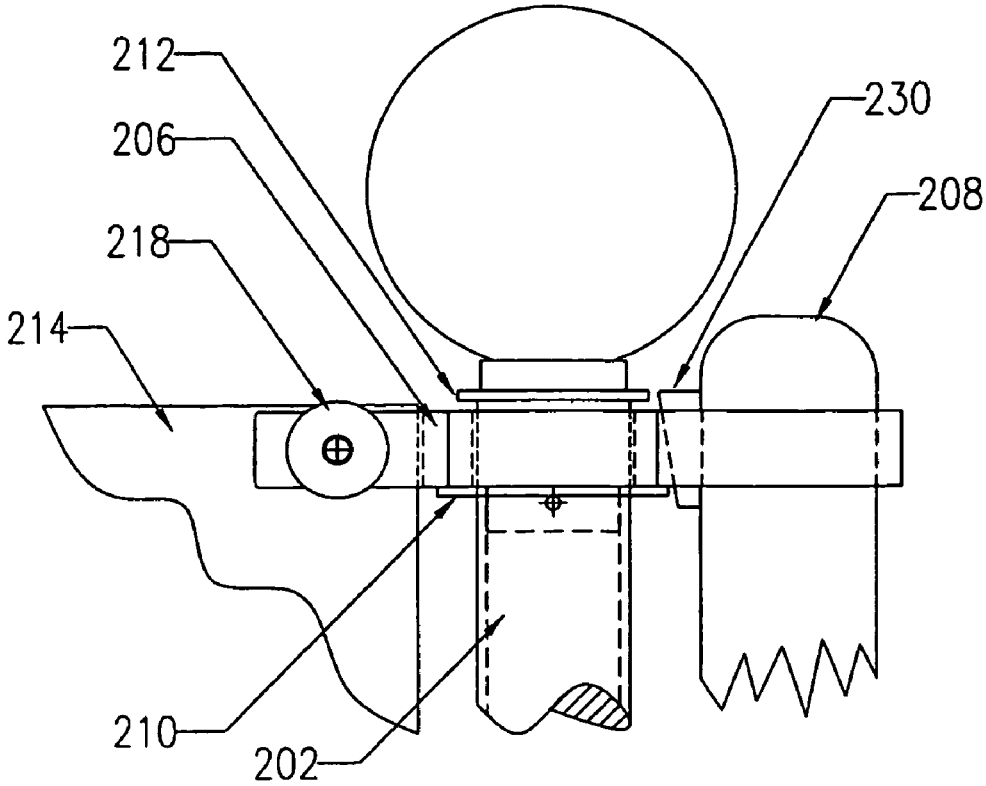
FIG. 10 is a close up side view of a swivel for the flag unfurling device of the present invention showing the flag mounted to a bracket with a thumb screw, and a wedge-lock mechanism adjacent the baton to fix the baton relative to the upper swivel.

*FIG. 10 is a close up side view of the upper swivel shown in FIG. 7 for the flag unfurling device of the present invention 200 showing the flag 214 mounted to swivel 206 with a thumb screw 218. Wedge-lock 230 adjacent the baton 208 accommodate flags 214 having different heights by positioning the wedge 230 in place once the baton 208 is positioned within the swivel 206. The baton may easily be removed from the swivel 206 simply by depressing the wedge 230 to disengage the baton 208 from the swivel 206.

Figure 11:
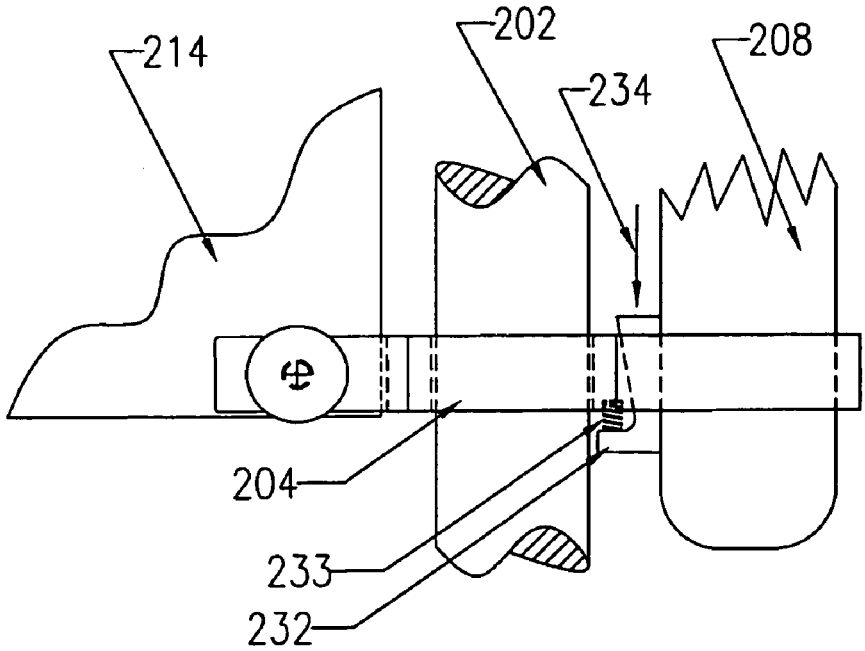
FIG. 11 is an alternative embodiment of the swivel for the flag unfurling device of the present invention showing a spring-loaded wedge that, once depressed, allows the swivel to move along the length of the baton to accommodate flags having different heights, and to easily remove tension from the flag for easy removal simply by depressing the wedge lock to disengage the baton from the swivel.

FIG. 11 is a close up side view of swivel 204 for the flag unfurling device of the present invention 200 showing a spring-loaded wedge 232 that has a spring 233 which retains the wedge in position between the baton 208 and the swivel 204. Once the wedge 232 is pressed in direction 234, the friction is removed between baton 208 and swivel 204, and the swivel may move along the length of the baton 208 for adjustment. The baton may easily be removed from the swivel 206 simply by depressing the wedge 230 to disengage the baton 208 from the swivel 206.

Figure 12:
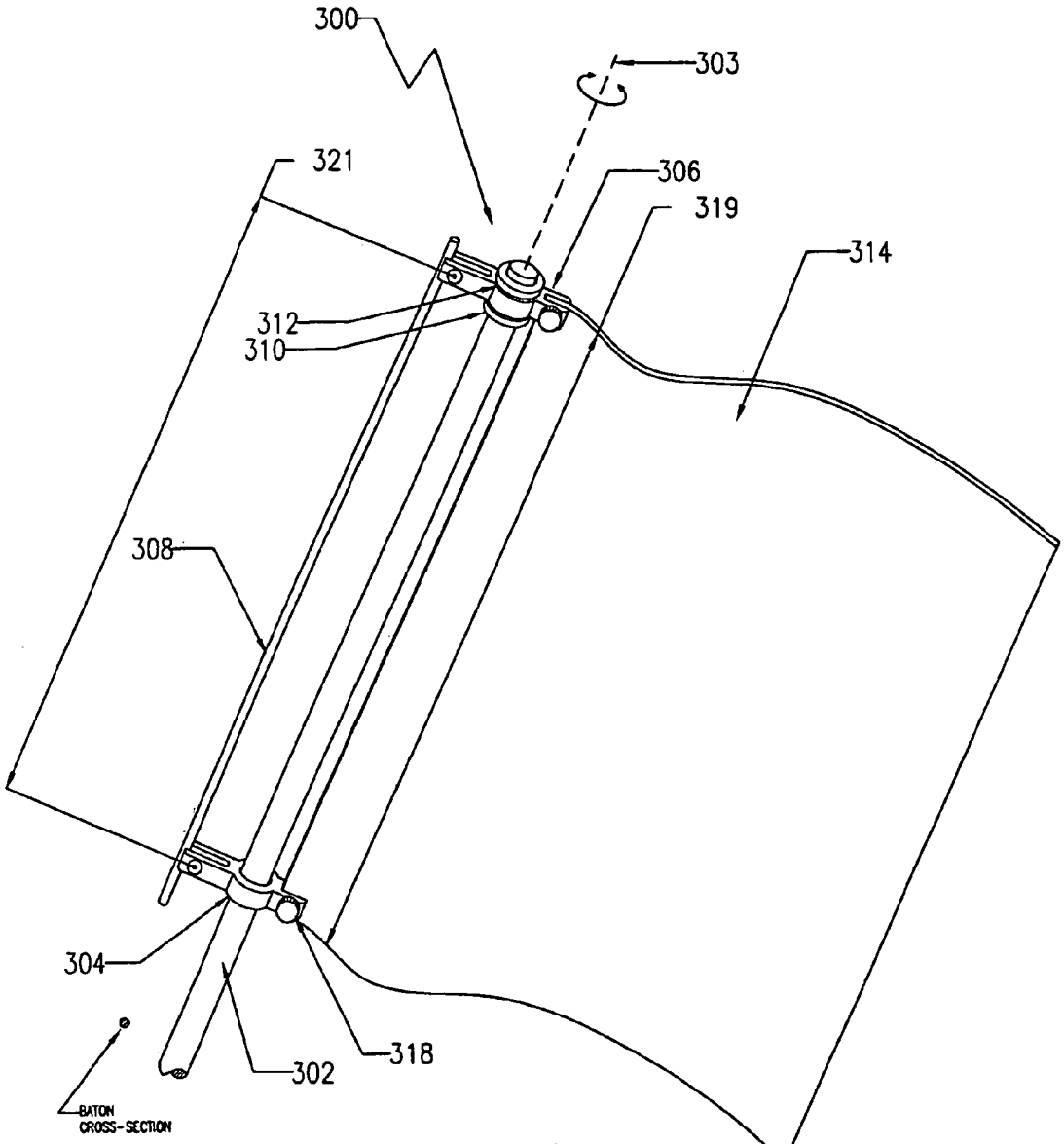
FIG. 12 is an alternative embodiment of the flag unfurling device of the present invention showing a rod-shaped baton captured within a swivel that provides for the continual adjustment for flags having different heights.

Referring now to FIG. 12, an alternative embodiment of the flag unfurling device of the present invention is shown and generally designated 300. Device 300 is mounted on a flag pole 302 and includes a lower swivel 304 and an upper swivel 306 which together support a baton 308. The upper swivel 306 is retained on pole 302 by retaining rings 310 and 312, which maintain the upper swivel 306 in proper position, while allowing the free rotation of the swivel around the axis 303 of pole 302. A flag 314 is attached to the upper and lower swivels 304 and 306 with thumb screws 318, and the baton 308 maintains the distance 321 appropriate to hold flag 314 in place.

Device 300 includes a showing a rod-shaped baton 308 captured within a swivel 304 and 306 that provides for the continual adjustment for flags 314 having different heights 319. Specifically, the separation of the swivels 304 and 306 can be adjusted along the entire length 321 of rod baton 308.

Figure 13:
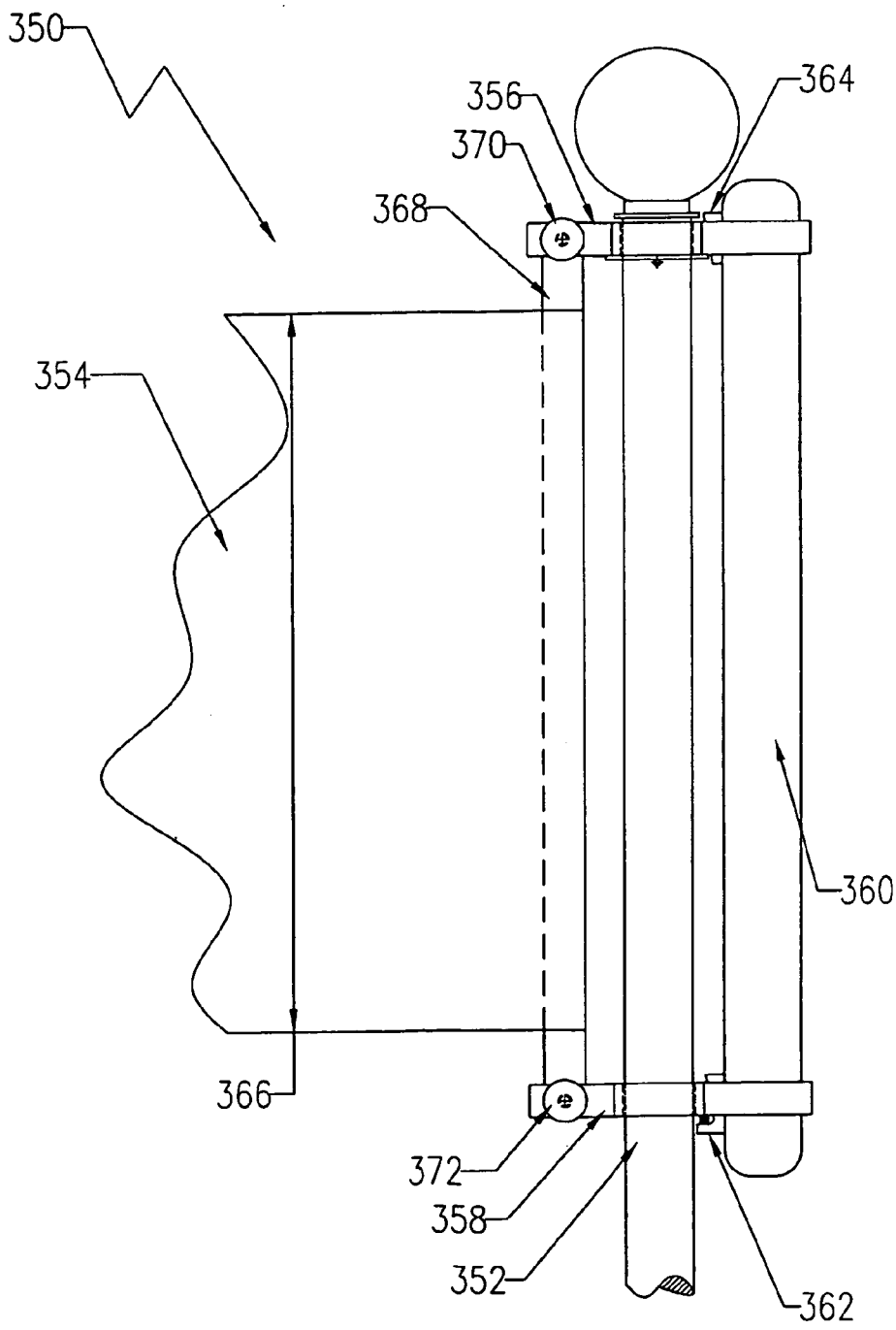
FIG. 13 is an alternative embodiment of the flag unfurling device of the present invention showing a horizontal pole supporting a vertically hanging flag, and equipped with a baton with a wedge-lock mechanism to accommodate flags of different widths, with the flag supported by a banner-type flag rod extending between two thumb screws.

FIG. 13 shows an alternative embodiment of the flag unfurling device of the present invention generally designated 350. Device 350 is particularly suited for a horizontally mounted pole 352 supporting a vertically hanging flag 354., such as flags known as a banner-type flag. Swivels 356 and 358 are separated by baton 360. Device 350 is equipped with a baton 360 with a wedge-lock mechanism 362 and 364 to accommodate flags 354 of different widths 366. Flag 354 is supported by a rod 368 extending between two thumb screws 370 and 372.

Figure 14:
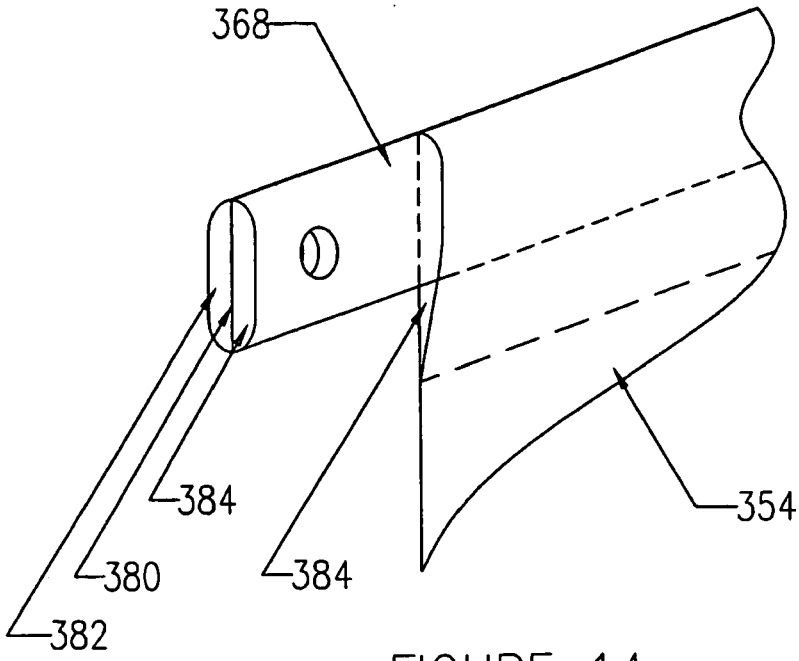
FIG. 14 is a perspective view of a supporting rod of the flag unfurling device of the present invention with a longitudinal split allowing for the flag to pass through the middle of the rod thereby maintaining the proper lateral positioning of the flag on the pole.
Figure 15:
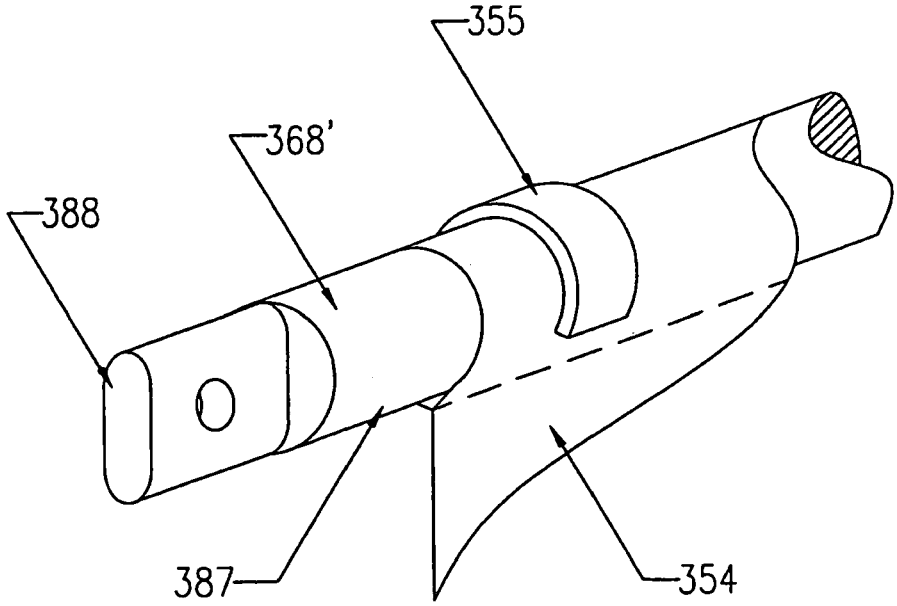
FIG. 15 is an alternative embodiment of a supporting rod of the flag unfurling device of the present invention with a tubular midsection, formed with blade ends to be received within the swivel; and equipped with a positioning clip to maintain the proper lateral positioning of the flag on the pole.

FIGS. 14 and 15 are perspective views of supporting rods of the flag unfurling device of the present invention 350. Specifically, rod 368 of FIG. 14 is formed with a longitudinal split 380 allowing for the use of a banner-type flag 354 to pass between rod halves 382 and 384 thereby maintaining the proper lateral positioning of the flag 354 on the rod 368.

The rod 368' of FIG. 15 is an alternative embodiment of a supporting rod of the flag unfurling device of the present invention 350 with a tubular midsection, 387 formed with blade ends 388 to be received within the swivels 356 and 358. A positioning clip 355 is placed around flag 354 to maintain the proper lateral positioning of the flag 354 on the rod 368'.

Figure 16:
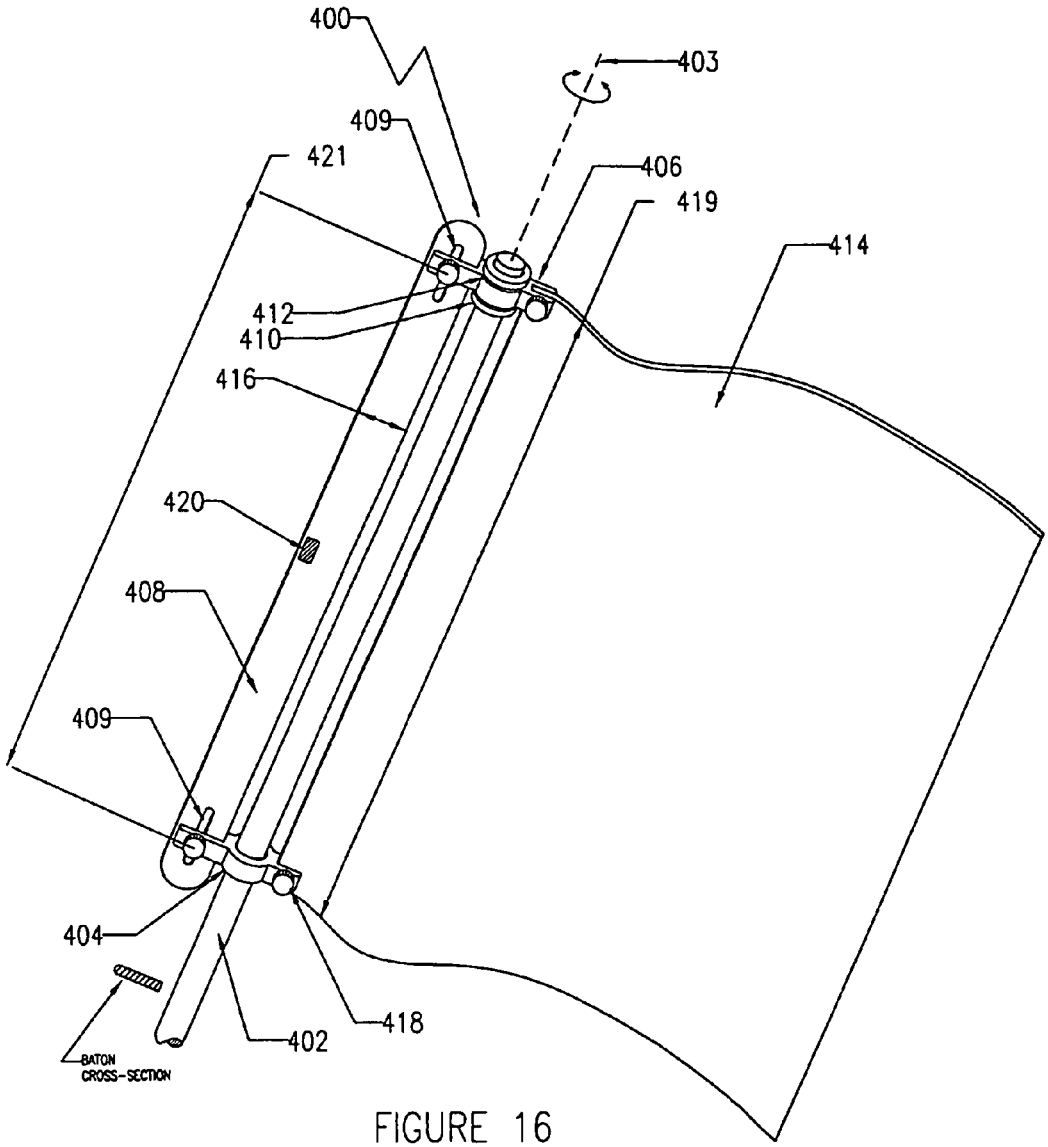
FIG. 16 is an alternative embodiment of the flag unfurling device of the present invention showing a baton formed with a single adjustment slot on each end, and allowing the adjustment of the positioning of the swivels for flags having different heights.

FIG. 16 is an alternative embodiment of the flag unfurling device of the present invention and generally designated 400. Device 400 is mounted on a flap pole 402 and includes a lower swivel 404 and an upper swivel 406 which together support a baton 408 formed with a single adjustment slot 409 on each end, and allows the adjustment of the separation 421 of the swivels 404 and 406 for flags having different heights 419. The upper swivel 406 is retained on pole 402 by retaining rings 410 and 412. which maintain the upper swivel 406 in proper position, while allowing the free rotation of the swivel around the axis 403 of pole 402. A flap 414 is attached to the upper and lower swivels 404 and 406 with thumb screws 418, and the baton 408 maintains the distance 421 appropriate to hold flap 414 in place. The baton 408 has a width 416 than can vary by application, with particular widths being dependent on the height 419 of the flag 414, such as a larger width 416 for a bigger flag. Additionally, the weight of baton may be increased by adding weights 420 to increase the weight, and overall moment of inertia, of the baton assembly. Baton 408 is formed with adjustment slots 409 sized to be adjusted within the upper and lower swivels 404 and 406 thereby accommodating flags having different heights 419. Baton 408 is equipped with thumb screws (like thumb screws 510 in FIG. 17) to adjust the separation of the swivels 404 and 406 for flag 414.

FIG. 17 is an alternative embodiment of the flag unfurling device of the present invention and generally designated 500. Device 500 includes a triangular shaped sail 502, supported by a sail support 504 that provides rigidity to sail 502. Sail 502 extends from baton 506 formed with a single adjustment slot 508 on each end and equipped with thumb screws 510 to adjust the separation of the swivels 512 and 514 for flag 516. Swivels 512 and 514 freely rotate around the axis 503.

Figure 18:
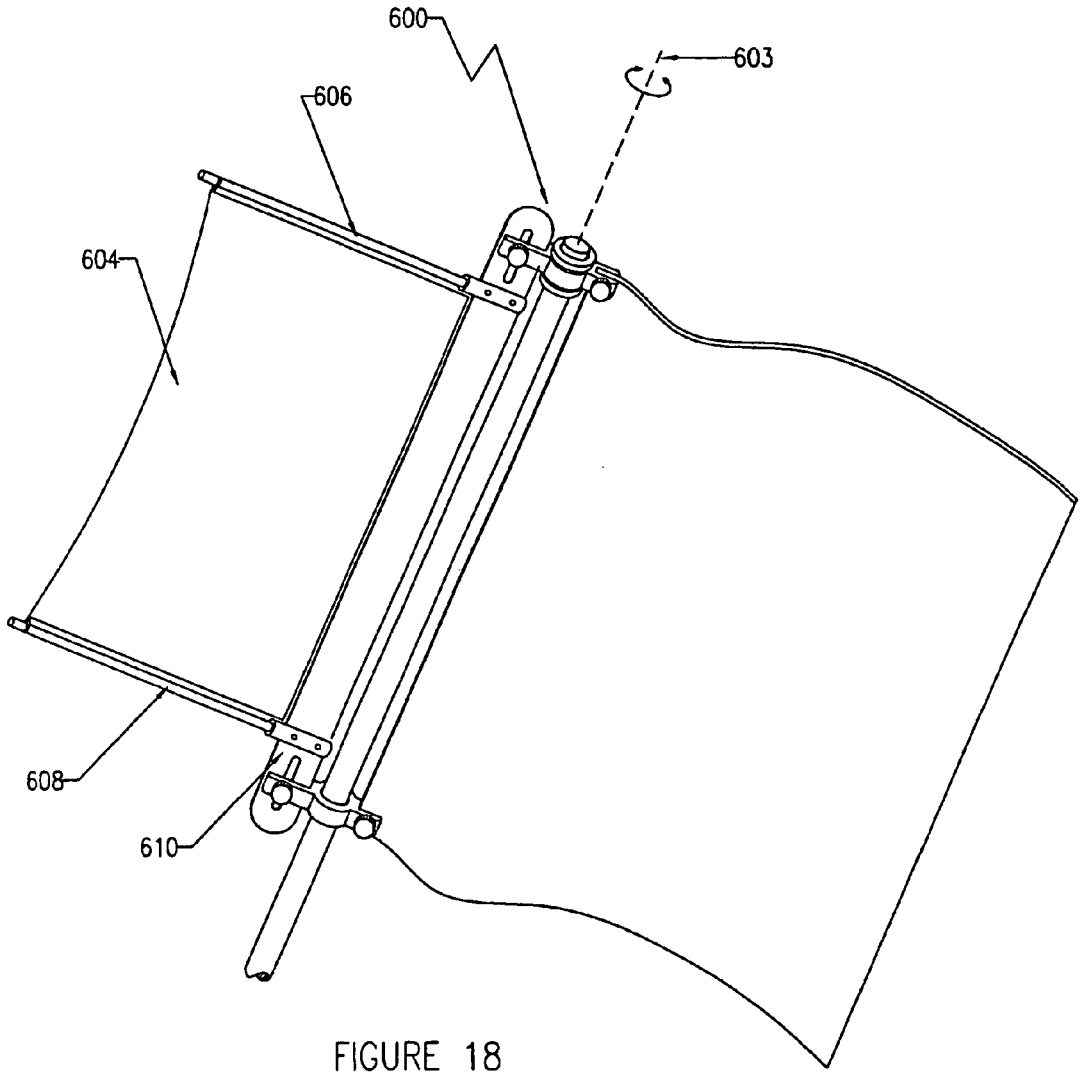
FIG. 18 is an alternative embodiment of the flag unfurling device of the present invention showing a rectangular shaped sail extending from a baton formed with a single adjustment slot on each end.

FIG. 18 is an alternative embodiment of the flag unfurling device of the present invention and generally designated 600. Device 600 includes a rectangular shaped sail 604 supported by sail supports 606 and 608 which extend from baton 610 formed with a single adjustment slot on each end. Device 600 rotates around axis 603.

Figure 19:
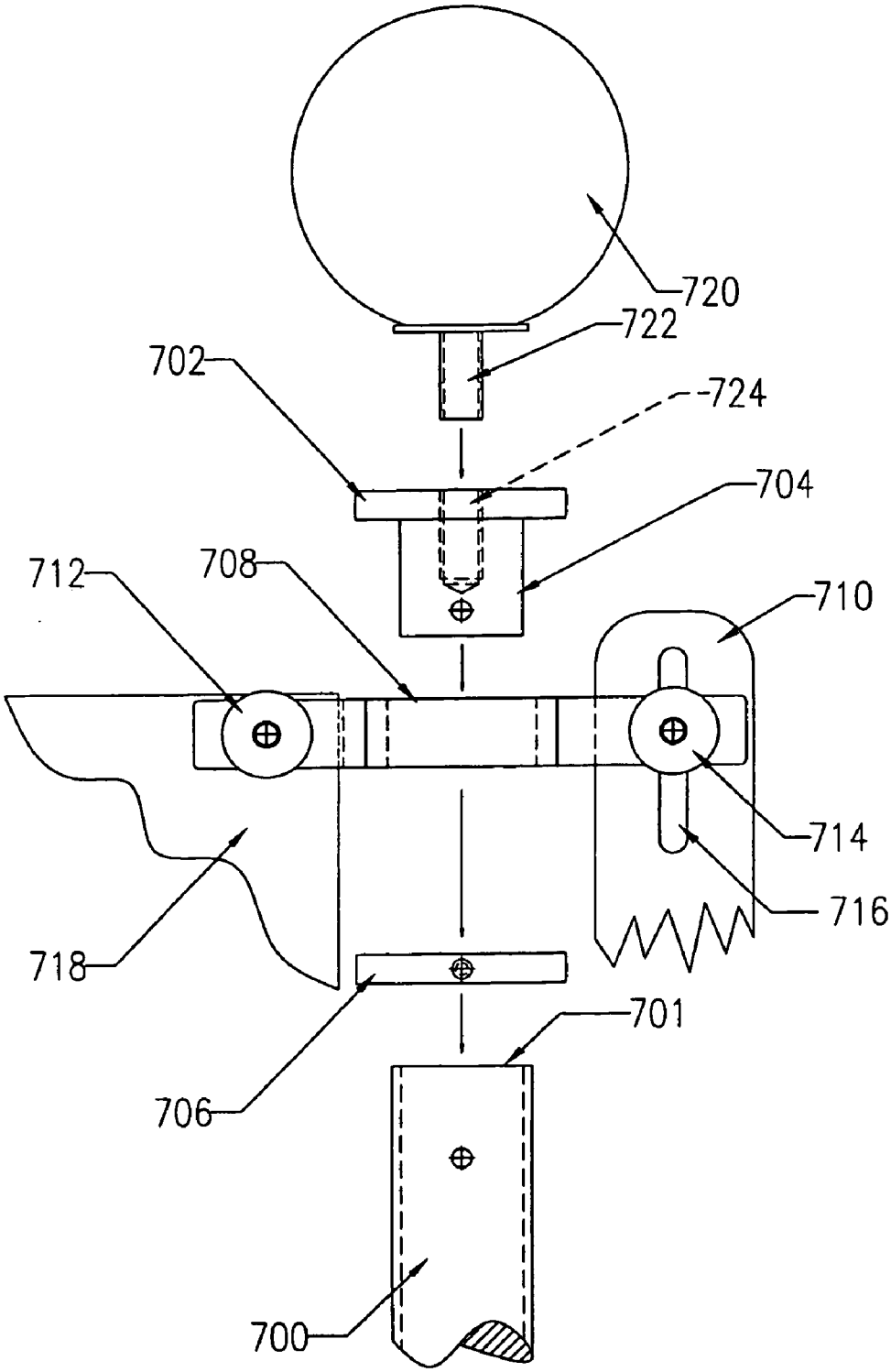
FIG. 19 is an exploded view of the end of a flag pole equipped with the flag unfurling device of the present invention and showing the plug formed to be inserted into the open end of a flag pole, a swivel sized to be positioned over the flag pole and rotate freely thereon, and a bottom stop that is inserted over the flag pole and captures the swivel between the stop and plug.

Referring now to FIG. 19, an exploded view of a flag pole 700 equipped with the flag unfurling device of the present invention shows a cap 702 formed with an insert 704 to be inserted into the open end 701 of flag pole 700. A retaining ring 706 is also sized to slip over the outer surface of pole 700 and capture swivel 708 between ring 706 and cap 702, allowing the swivel 708 to rotate freely on the pole 700. Baton 710 is formed with a slot 716 to be secured with thumb screw 714, and provides a separation distance to accommodate flag 718. Flag 718 is attached to swivel 708 with thumb screw 712. Cap 702 may be topped with a ball 720 having a mounting stud 722 to be received in bore 724 of cap 702.

Figure 20:
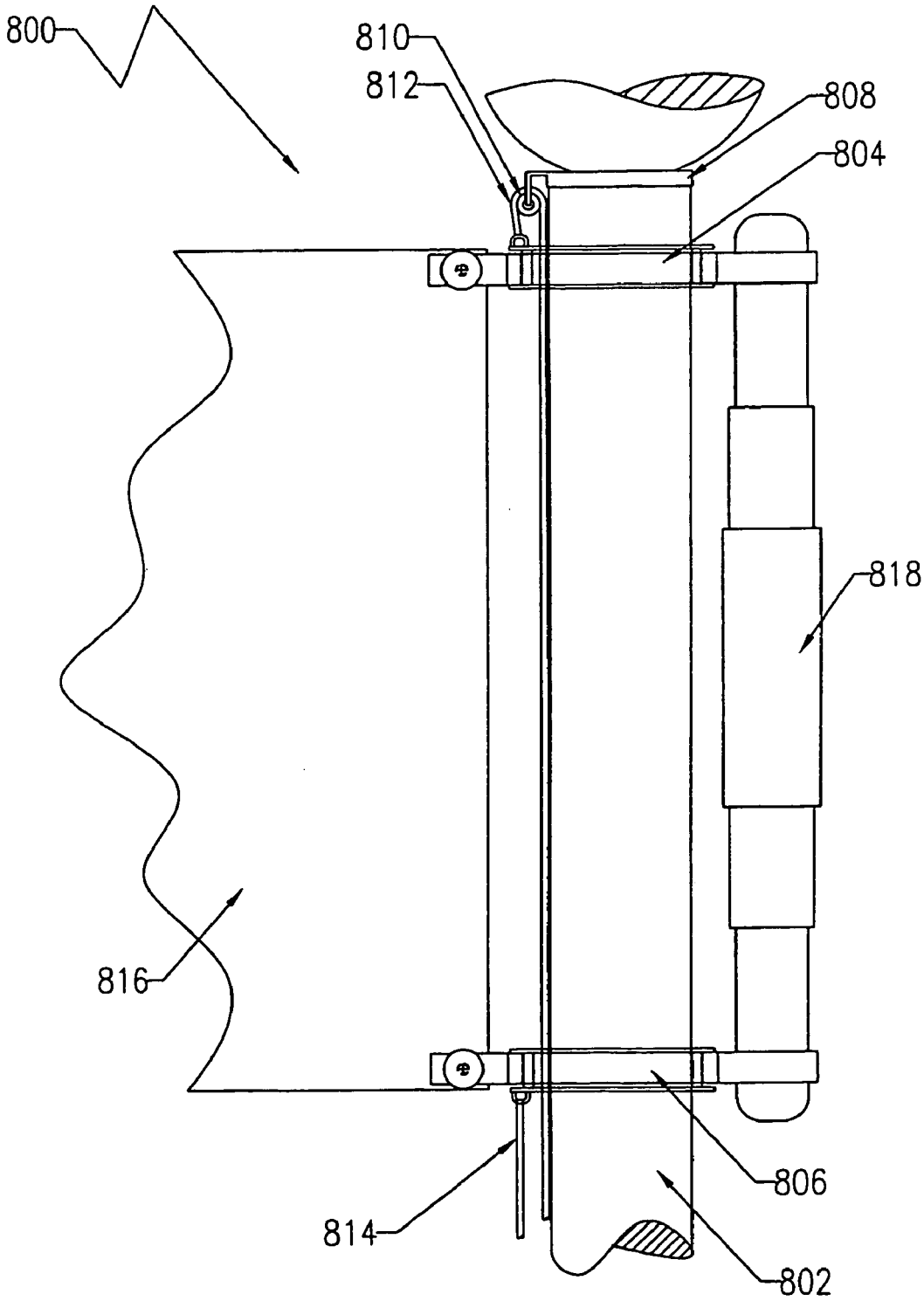
FIG. 20 is a side view of an alternative embodiment of the flag unfurling device of the present invention showing an upper and lower swivel attached to a cord so that the flag may be mounted to the flag unfurling device of the present invention and raised and lowered on the flag pole, with an extendable baton allowing for the collapsing of the upper and lower swivels together to facilitate installation and removal of a flag.

FIG. 20 is a side view of an alternative embodiment of the flag unfurling device of the present invention and generally designated 800. Device 800 is mounted on a pole 802 and includes an upper swivel 804, a lower swivel 806, and an upper pole cap 808. Pole cap 808 is equipped with a pulley 810 over which passes cord 812. Cord 812 allows a user to raise upper swivel 804 to the top of a flag pole in a manner consistent with ordinary flag poles by pulling downward on cord 812.

Lower swivel 806 is equipped with a lower cord 814 which allows the lower swivel to be pulled downwards to expand flag 816 to its full height. Baton 818 is an extendable baton allowing for the extension of the baton while the flag is being displayed at the top of a flag pole, and can be collapsed so that the upper swivel 804 and the lower swivel 806 are brought together, such as while removing the flag from the pole 802.

FIG. 21 is a cross-sectional view of the upper swivel attachment of FIG. 20 detailing the positioning of the swivel 804 on the flag pole 802. From this Figure, the routing of the cord 812 through an internal notch 820 formed in swivel 804 can be seen.

Figure 22:
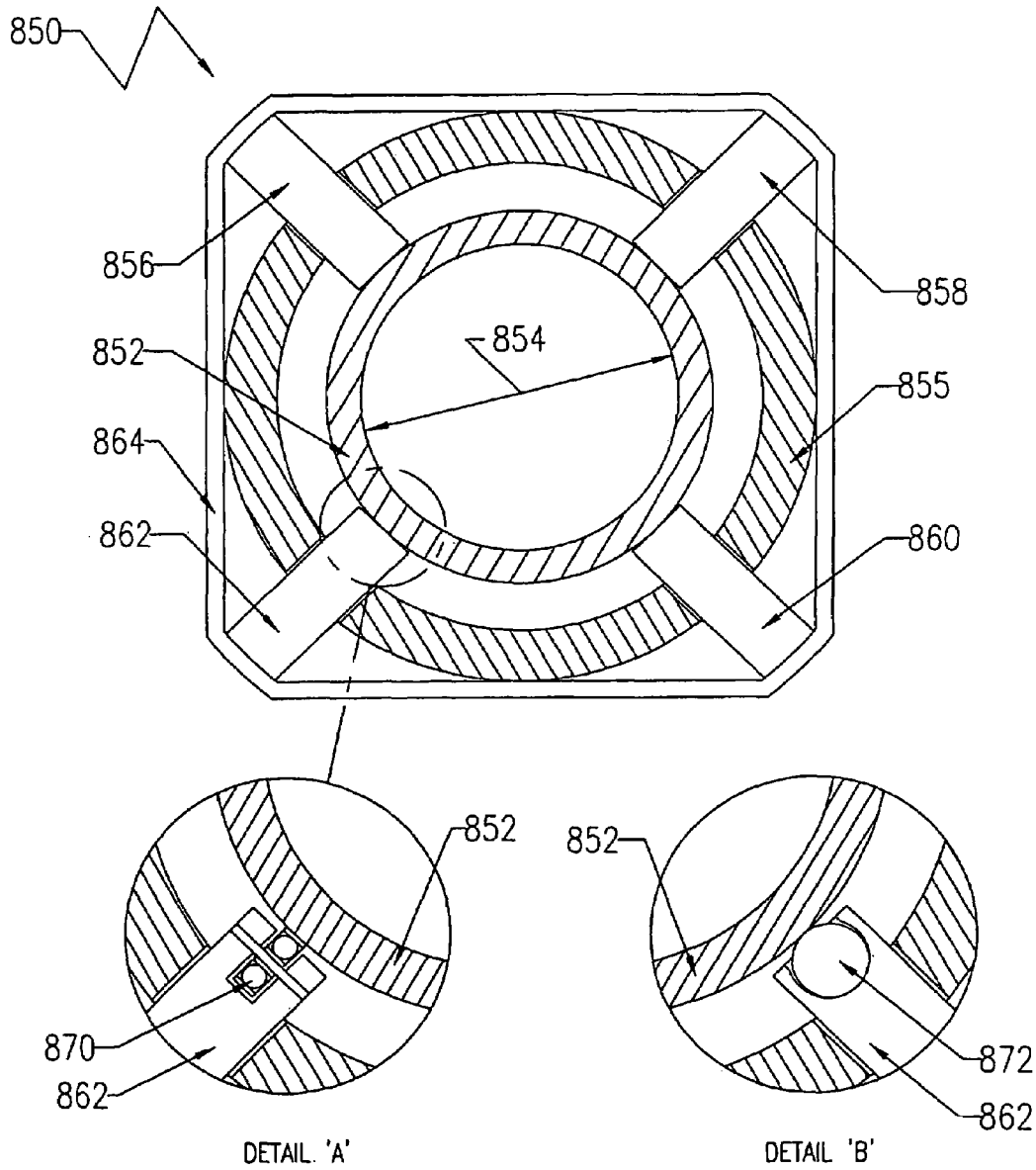
FIG. 22 is a cross-sectional view of a friction mounting sleeve that is designed to accommodate the flag unfurling device of the present invention as installed on tapered flag poles having a narrowing diameter allowing the device to be attached on the pole at the base having a larger diameter, and moving upwards on the pole to a position having a smaller diameter, and eliminating any rattling of the sleeve on the pole.

Referring now to FIG. 22, a cross-sectional view of a mounting sleeve is shown and generally designated 850. Sleeve 850 is positioned around flag pole 852, which may have a varying diameter 854. In use with pole having a varying diameter, sleeve 850 is made with a ring 855 and formed to receive a number of inserts 856, 858, 860 and 862. These inserts are retained in an inward urged position by elastic band 864 so that the inserts contact the outer surface of the pole 852 maintaining the concentric orientation of the ring 855 about the pole 852. The sleeve 850 of the present invention can be installed on a tapered flag pole 852 having a broad base in which the inserts 862 are pressed outwards from ring 855. Then, as the flag is raised to a portion of the pole 852 having a narrower diameter, the elastic band 864 urges inserts 862 inwards maintaining contact with the surface of flag pole 852 and eliminating any rattling of the sleeve on the pole.

It is to be appreciated that FIG. 22 depicting four inserts 862 is merely exemplary of a preferred embodiment, and that any other number of inserts are contemplated herein. Also, details A and B of FIG. 22 show how inserts 862 may be formed with rollers 870 and 872 which roll to minimize the friction between inserts 862 and flag pole 852.

Figure 23:
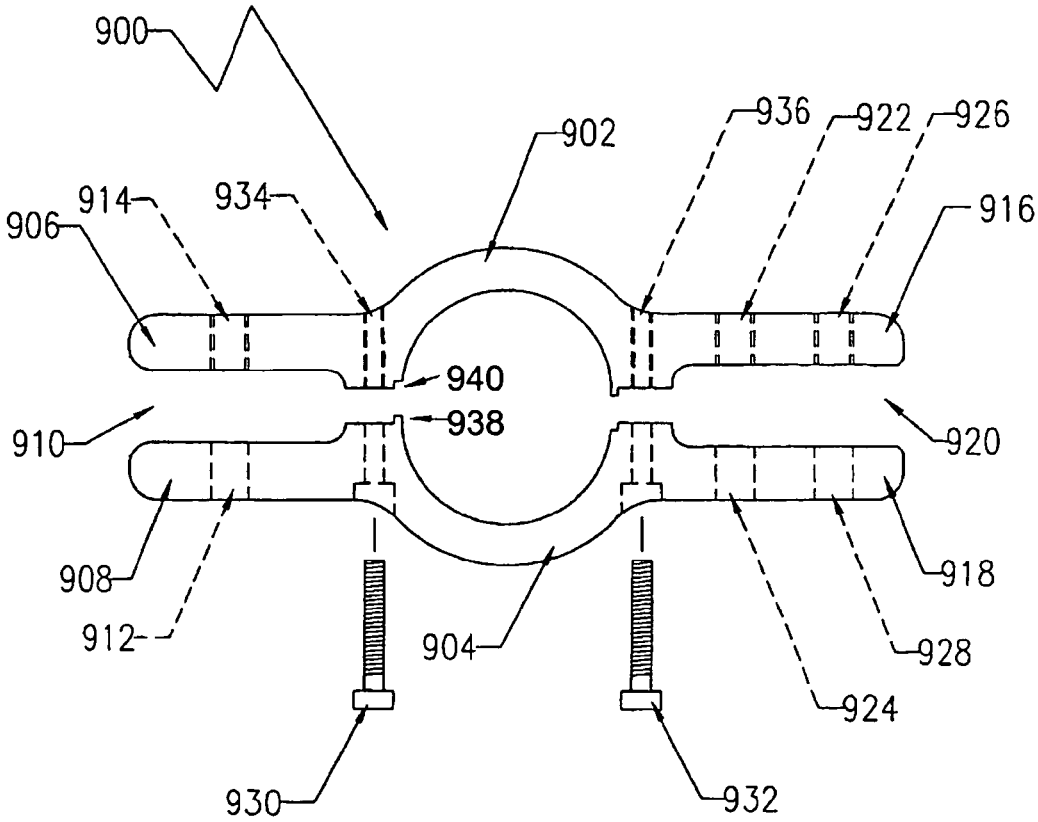
FIG. 23 is a cross-sectional view of a two-piece swivel that can be positioned over a flag pole, and secured about the pole with fasteners, such as machine screws, without the need for accessing either end of the flag pole which is particularly difficult in an institutional pole where the pole is mounted in concrete, and extends perhaps thirty to fifty feet high.

Referring now to FIG. 23, a cross-sectional view of a two-piece swivel that is generally designated 900 is shown. Swivel 900 includes two halves 902 and 904 that can be separated, positioned over a flag pole, and assembled. Half 902 includes a flag tab 906 which, in combination with flag tab 908, form flag receiver 910. A thumb screw may be inserted through bore 912 to threads 914 to secure the flag in place.

Half 902 includes a baton tab 916 which, in combination with baton tab 918, form baton receiver 920. Thread bores 922, 924, 926, and 928 receive fasteners to secure the baton in place in baton gap. The two halves may be fastened together by inserting screws 930 and 932 into threaded bores 934 and 936. Alignment tabs 938 align with notches 940 to ensure the proper alignment of the two halves about the flag pole.

This swivel is particularly useful in circumstances where accessing either end of the flag pole is difficult, such as with an institutional flag pole where the pole is mounted in concrete, and extends perhaps thirty to fifty feet high.

Figure 24:
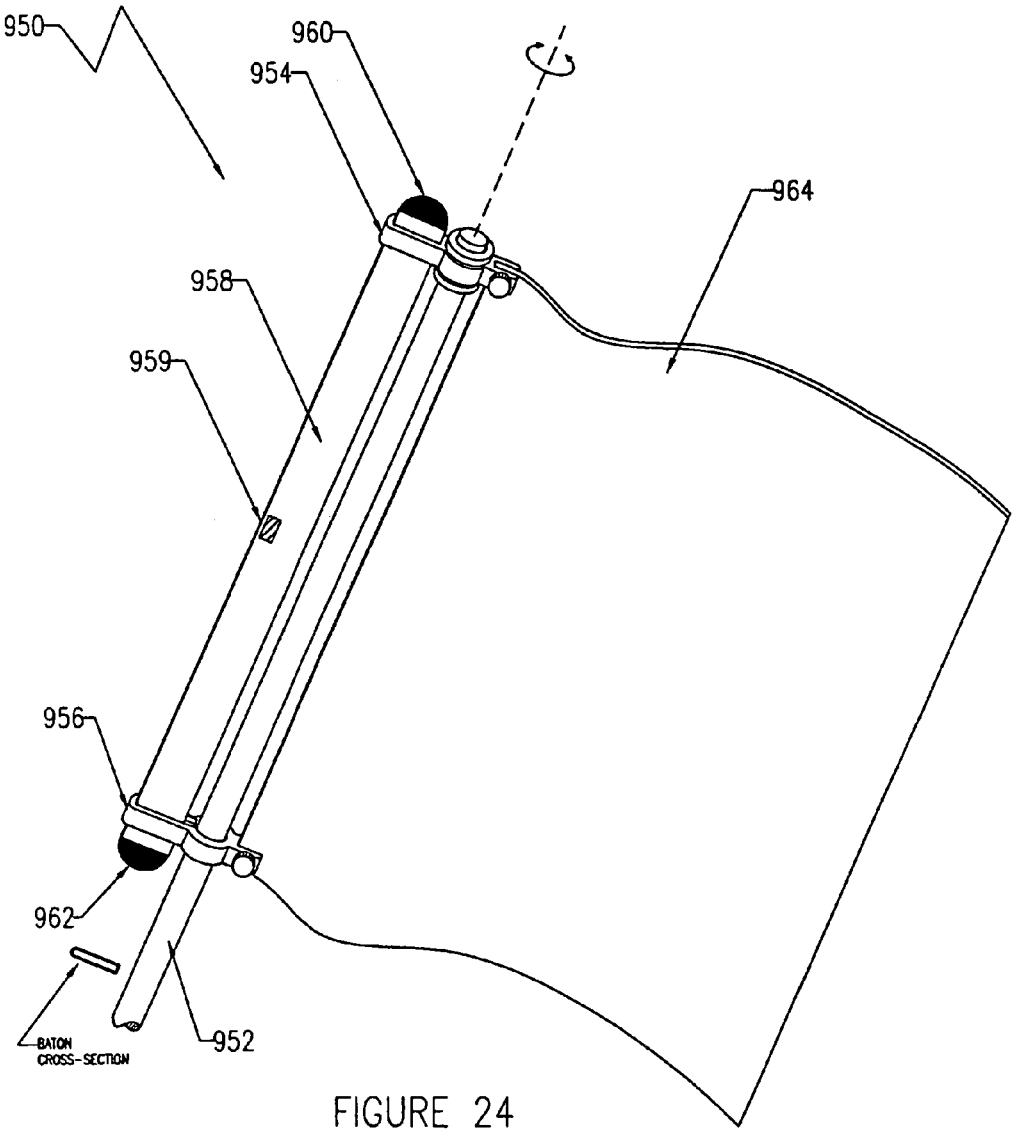
FIG. 24 is a perspective view of an alternative embodiment of the flag unfurling device of the present invention showing a baton having a hollow cross-section and equipped with an end cap which prevents the upper and lower swivel from separating.

Referring to FIG. 24, a perspective view of an alternative embodiment of the flag unfurling device of the present invention is generally designated 950. Device 950 is mounted on flag pole 952 and includes an upper swivel 954, a lower swivel 956, and a baton 958 which may be equipped with a weight 959. The baton is an extruded hollow tube, having an end cap 960 and 962 on each end which seals the baton and prevents the upper and lower swivels 954 and 956 from separating. Flag 964 is attached to swivels 954 and 956.

While the particular flag pole mounted unfurling device as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. A flag pole mounted unfurling device, comprising:

an upper swivel disposed on a flag pole and rotatable thereon;

a lower swivel disposed on said flag pole and rotatable thereon;

a baton connected between the upper swivel and the lower swivel, said baton formed with an upper and lower longitudinal adjustment slot adjacent each respective swivel, whereas said slot passes therethrough said baton; and a means for attaching a flag between the upper swivel and the lower swivel; said means being located diametrically opposite said baton, with respect to the flag pole.

2. The flag pole mounted unfurling device of claim 1, wherein the baton has a substantially rectangular cross-section.

3. The flag pole mounted unfurling device of claim 1, wherein the baton has a substantially circular cross-section.

4. The flag pole mounted unfurling device of claim 1, wherein the upper swivel and lower swivel are formed with thumb screws, and wherein the longitudinal adjustment slot adjacent each swivel receives said thumb screws.

5. The flag pole mounted unfurling device of claim 1, wherein the means for attaching the flag between the upper swivel and the lower swivel further comprises a rod extending between the upper swivel and the lower swivel.

6. The flag pole mounted unfurling device of claim 1, wherein the means for attaching the flag between the upper swivel and the lower swivel further comprises the flag being formed with an eyelet adjacent each swivel, and each swivel formed to receive a portion of the flag wherein a fastener is inserted through the swivel and eyelet to secure the flag to the swivel.

7. The flag pole mounted unfurling device of claim 1, wherein the flag is a banner type flag, wherein the means for attaching the flag between the upper swivel and the lower swivel further comprises a banner-type flag adapter sized to be inserted through the opening of a banner flag and secured to the upper swivel and lower swivel.

8. The flag pole mounted unfurling device of claim 7, wherein the banner-type flag adapter is formed with a longitudinal split extending at least from one end of the banner-type flag adaptor to receive a portion of the banner flag to secure the flag within the split.

9. The flag pole mounted unfurling device of claim 7, wherein the banner flag is attached to the banner-type flag adapter with a clip.

10. The flag pole mounted unfurling device of claim 1, wherein the baton is extendable from a first length to a second length.

11. The flag pole mounted unfurling device of claim 1, further comprising a sail extending from the baton.

12. The flag pole mounted unfurling device of claim 1, wherein the baton has an airfoil-shaped cross-section.

13. The flag pole mounted unfurling device of claim 1, wherein the baton has a hollow cross-section.

14. A flag pole mounted unfurling device for use on a flag pole having a top and a pole, comprising:

an upper swivel formed with a bore to receive the pole;

a means to retain the upper swivel on the pole adjacent the top of the pole;

a lower swivel formed with a bore to receive the pole;

a baton connected from the upper swivel to the lower swivel, said baton formed with an upper and lower longitudinal adjustment slot adjacent each respective swivel, whereas said slot passes therethrough said baton and;

a means to secure a flag to the upper swivel and the lower swivel; said means being located diametrically opposite said baton, with respect to the flag pole.

15. The flag pole mounted unfurling device of claim 14, further comprising an upper stop cap insertable into the top of the pole and a lower stop formed with a bore and positionable on the pole wherein the upper swivel is captured between the upper stop cap and lower stop, and axially rotatable on the pole.

16. The flag pole mounted unfurling device of claim 14, further comprising:

a mount formed on each swivel and sized to receive a portion of the flag; and a means for securing the flag in the mount.

17. The flag pole mounted unfurling device of claim 16, wherein the means for securing the flag in the mount further comprises the mount formed with a threaded bore and a thumbscrew insertable through the threaded bore and a portion of the flag.

18. The flag pole mounted unfurling device of claim 14, wherein said baton is formed with a substantially circular cross-section.

19. The flag pole mounted unfurling device of claim 14, wherein said baton is formed with a substantially rectangular cross-section.

20. The flag pole mounted unfurling device of claim 14, wherein said baton is extendable.

* * * * *